US008531117B2

(12) United States Patent
Cho et al.

(10) Patent No.: US 8,531,117 B2
(45) Date of Patent: Sep. 10, 2013

(54) LIGHTING APPARATUS USING PN JUNCTION LIGHT-EMITTING ELEMENT

(75) Inventors: Seung Hyun Cho, Gyeonggi-do (KR); Ji Wan Kim, Gyeonggi-do (KR)

(73) Assignee: Wooree Lighting Co., Ltd., Gyeonggi-Do (KR)

( * ) Notice: Subject to any disclaimer, the term of this patent is extended or adjusted under 35 U.S.C. 154(b) by 264 days.

(21) Appl. No.: 13/081,621

(22) Filed: Apr. 7, 2011

(65) Prior Publication Data

US 2012/0217883 A1 Aug. 30, 2012

(30) Foreign Application Priority Data

Feb. 25, 2011 (KR) ..... 10-2011-0016995

(51) Int. Cl.
*H05B 37/00* (2006.01)
*H05B 39/00* (2006.01)
*H05B 41/00* (2006.01)

(52) U.S. Cl.
USPC ..... 315/185 R; 315/192; 315/193; 315/291

(58) Field of Classification Search
None
See application file for complete search history.

(56) References Cited

U.S. PATENT DOCUMENTS

| | | | | |
|---|---|---|---|---|
| 5,663,719 | A * | 9/1997 | Deese et al. | 340/912 |
| 6,193,392 | B1 * | 2/2001 | Lodhie | 362/235 |
| 7,891,853 | B2 | 2/2011 | Park | |
| 2008/0192476 | A1 | 8/2008 | Hiratsuka | |

FOREIGN PATENT DOCUMENTS

| | | |
|---|---|---|
| JP | 2002-358035 | 12/2002 |
| JP | 2010-049830 | 3/2010 |
| KR | 10-0923982 | 10/2009 |
| KR | 100926040 | 11/2009 |
| KR | 1020100052629 | 5/2010 |

OTHER PUBLICATIONS

English Summary of a Korean Patent Office Action for the priority Korean Patent Application No. 10-2011-0016995 dated Jul. 18, 2012; 5 pgs.
English translation of Written Opinion of the International Searching Authority for PCT/KR2011/008362 which claims priority to KR-10-2011-0016995; 4 pgs.

* cited by examiner

*Primary Examiner* — Anh Tran
(74) *Attorney, Agent, or Firm* — Harness, Dickey & Pierce, P.L.C.

(57) ABSTRACT

The present disclosure discloses a lighting apparatus using a PN junction light-emitting element, the apparatus comprising: a power transmitting substrate; PN junction light-emitting elements mounted on the power transmitting substrate; circuit elements mounted on the power transmitting substrate and controlling power provided to the PN junction light-emitting elements; and a top cover covering the circuit elements and forward reflecting light emitted by the PN junction light-emitting elements.

18 Claims, 10 Drawing Sheets

LIGHTING APPARATUS USING PN JUNCTION LIGHT-EMITTING ELEMENT

CROSS-REFERENCE TO RELATED APPLICATIONS

This application claims the benefit and priority of Korean patent Application No. KR-10-2011-0016995, filed Feb. 25, 2011. The entire disclosure of the above application is incorporated herein by reference.

FIELD

The present disclosure, in general, relates to a lighting apparatus using a PN junction light-emitting element, and more particularly, to a lighting apparatus using a PN junction light-emitting element that is slim and lightweight and easy to install on another object.

BACKGROUND

This section provides background information related to the present disclosure which is not necessarily prior art.

In a lighting apparatus using a PN junction light-emitting element, a light-emitting diode (LED) module having a plurality of LEDs mounted on a power transmitting substrate is typically used as a light source. The LEDs have the advantages of small size, low power consumption and excellent control characteristics, and therefore the LED lighting apparatus can be made slim and lightweight. However, a typical LED lighting apparatus includes a heat sink for heat dissipation or a separate drive circuit for driving an LED module. Elements such as the heat sink or the drive circuit make it difficult to realize a slim and lightweight design of the LED lighting apparatus.

For example, the drive circuit may include an A/D converter to supply DC power, and the A/D converter includes a trans-coil for lowering the voltage of AC. The trans-coil has a drawback in that, since the trans-coil is arranged occupying a large space in the drive circuit, the dimension of the product having the same becomes large.

Meanwhile, since the LED module includes a plurality of LEDs, the overall current capacity becomes large. Thus, the conventional LED drive circuit employs an electrolytic capacitor as a part. Such an electrolytic capacitor is suitable for a circuit with high capacitance, but its poor frequency characteristics and relatively high aging degradation reduce the reliability of the circuit. Particularly, in the case of an electrolytic capacitor being mounted, together with an LED, on a power transmitting substrate, the lifespan of the electrolytic capacitor is much shortened due to heat generated by light emission of the LED. Additionally, as the volume of an inductor and a capacitor increases in a circuit having a plurality of LEDs arranged thereon, this may even cause limitations to the exterior design of an LED lighting apparatus.

Moreover, the outer appearance of a lighting apparatus generally varies according to general classification of lamps, such as an incandescent lamp type and a fluorescent lamp type, and has various shapes according to use and place. Accordingly, the shapes of an LED module, a heat sink and a drive substrate also vary with such various shapes. In addition, lighting apparatuses of various shapes are each provided depending on a specific installation environment. Due to this, the lighting apparatus becomes less compatible according to use and place and its installation becomes difficult.

SUMMARY

This section provides a general summary of the disclosure and is not a comprehensive disclosure of its full scope or all of its features.

According to one aspect of the present disclosure, there is provided a lighting apparatus using a PN junction light-emitting element, the apparatus including: a power transmitting substrate; PN junction light-emitting elements mounted on the power transmitting substrate; a bottom cover positioned under the power transmitting substrate; a top cover positioned over the power transmitting substrate and having openings exposing the PN junction light-emitting elements; and a transparent window positioned over the top cover.

According to another aspect of the present disclosure, there is provided a lighting apparatus using a PN junction light-emitting element, the apparatus including: a power transmitting substrate; PN junction light-emitting elements mounted on the power transmitting substrate; a casing housing the power transmitting substrate in a manner that the PN junction light-emitting elements can be seen; a transparent window that is coupled to the casing over the power transmitting substrate; and a bracket that is coupled to the casing and securing the casing to another object.

Further areas of applicability will become apparent from the description provided herein. The description and specific examples in this summary are intended for purposes of illustration only and are not intended to limit the scope of the present disclosure.

DESCRIPTION OF DRAWINGS

The drawings described herein are for illustrative purposes only of selected embodiments and not all possible implementations, and are not intended to limit the scope of the present disclosure.

DETAILED DESCRIPTION

The present disclosure will now be described in detail with reference to the accompanying drawings.

Figure 1:
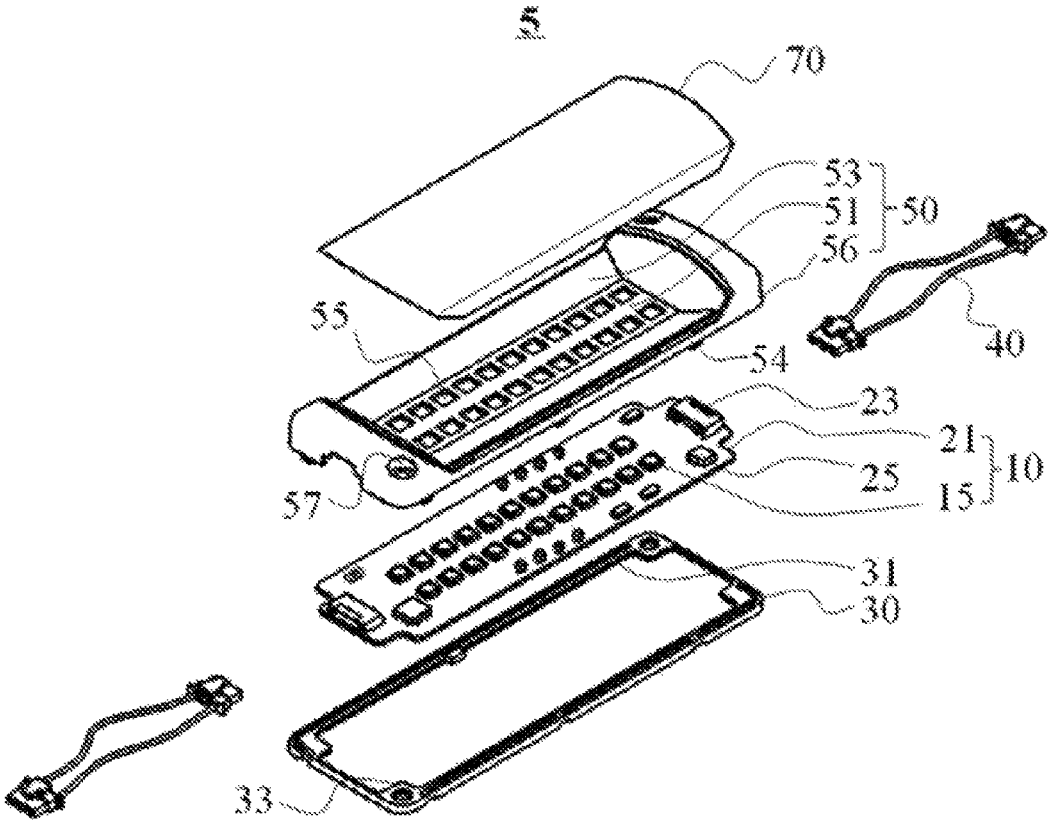
FIG. 1 is a view showing an example of a lighting apparatus using a PN junction light-emitting element according to the present disclosure.

FIG. 1 is a view showing an example of a lighting apparatus using a PN junction light-emitting element according to the present disclosure.

The lighting apparatus 5 using the PN junction light-emitting element includes a power transmitting substrate 21, PN junction light-emitting elements 15, a bottom cover 30, a top cover 50, and a transparent window 70.

The PN junction light-emitting elements 15 are mounted over the power transmitting substrate 21, and the power transmitting substrate 21 is housed between the bottom cover 30 and the top cover 50. Openings 55 for exposing the PN junction light-emitting elements 15 are formed in the top cover 50. The transparent window 70 is coupled to the top cover 50 and transmits light coming from the PN junction light-emitting elements 15. The lighting apparatus 5 using the PN junction light-emitting element has the advantage of being slim and lightweight because there is no need to use a heat sink and a drive substrate for driving the PN junction light-emitting elements 15.

Hereinafter, the lighting apparatus 5 using the PN junction light-emitting element will be described in detail, and the lighting apparatus 5 using the PN junction light-emitting element will be referred to as the lighting apparatus 5 for convenience of description.

The power transmitting substrate 21 receives power from an external source and supplies it to the PN junction light-emitting elements 15. The power transmitting substrate 21 may be a printed circuit board. The power transmitting substrate 21 may include a metal layer for heat dissipation, a wiring layer, a connector 23, and circuit elements 25. The wiring layer is formed on the metal layer and may include wiring and an insulating layer for insulating the wiring. The power transmitting substrate 21 may have various shapes, including a disc, a rectangular plate, a linear rod, etc. according to applications of the lighting apparatus 5.

As shown in FIG. 1, the connector 23 may be provided on each of the opposite short-side peripheries of the power transmitting substrate 21 of an approximately rectangular shape and receives power from an external source. A connection cable 40 is coupled to the connector 23 to apply transmitted power thereto. A plurality of lighting apparatuses 10 using a PN junction light-emitting element may be electrically connected to each other via the connection cable 40.

The circuit elements 25 are provided on the power transmitting substrate 21. The circuit elements 25 may be elements associated with power control. The shape and arrangement of the circuit elements 25 shown in FIG. 1 are illustrated for convenience of description, so that the circuit elements 25 can be provided over the power transmitting substrate 21 in various configurations. FIG. 1 shows a plurality of circuit elements as a typical example of the circuit elements 25. As shown in FIG. 1, the circuit elements 25 may be positioned on peripheries of the power transmitting substrate 21, i.e., in the vicinity of the PN junction light-emitting elements 15. The circuit elements 25 are of a simple configuration and are suitable to be incorporated with the PN junction light-emitting elements 15 on the power transmitting substrate 21. Preferably, the circuit elements 25 do not include an electrolytic capacitor having low heat resistance.

Unexplained reference numerals of FIG. 1 will be described later in this disclosure.

Figure 2:
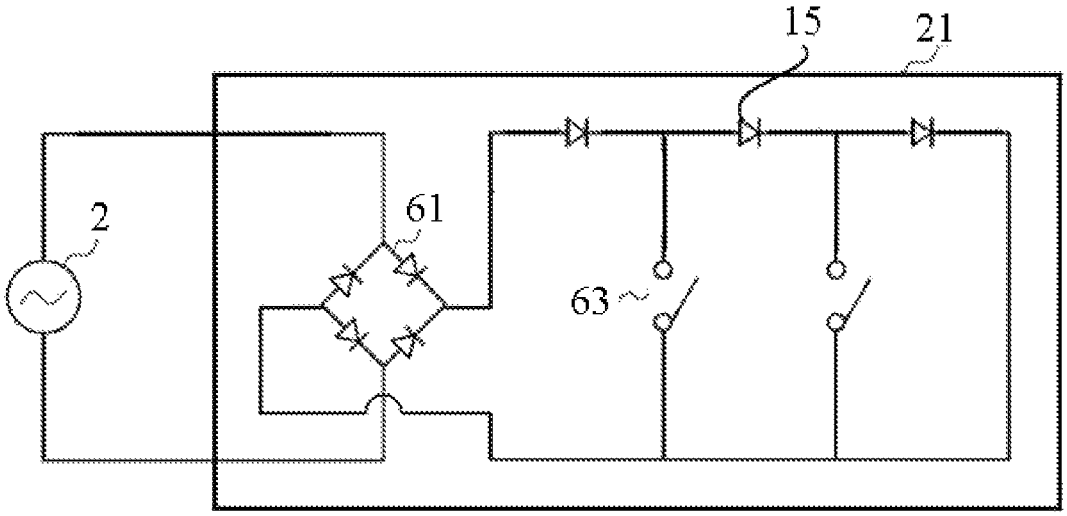
FIG. 2 is a view showing an example of electrical connection between a power transmitting substrate and PN junction light-emitting elements.
Figure 3:
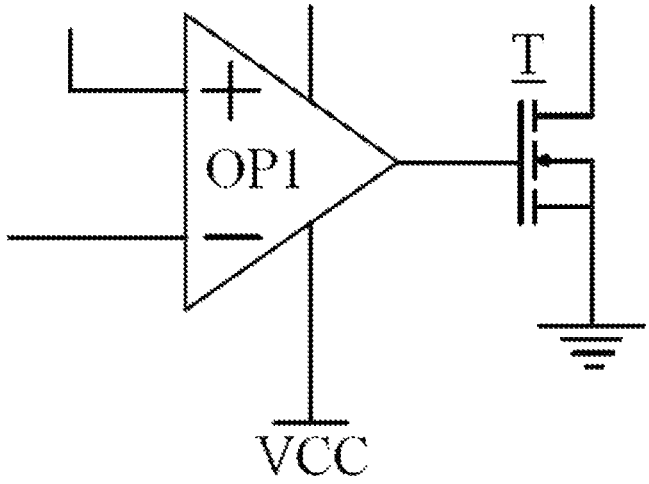
FIG. 3 is a view showing an example of the configuration of a switch of FIG. 2.

FIG. 2 is a view showing an example of electrical connection between the power transmitting substrate and the PN junction light-emitting elements. FIG. 3 is a view showing an example of the configuration of a switch of FIG. 2.

In an example of the circuit element 25, as shown in FIG. 2, a bridge rectifying circuit 61 is used to drive the PN junction light-emitting elements 15 by AC, i.e., by sine wave power 2. Accordingly, a heavy, large-volume element, such as an A/D converter, is not required to cause the PN junction light-emitting elements 15 to emit light.

Further, in an example of the circuit element 25, as shown in FIG. 2, in a circuit having a plurality of PN junction light-emitting elements 15 connected in series, switches 63 can be used to drive the PN junction light-emitting elements 15, while offering as wide a range of variation in input voltage as possible, by allowing electric current to flow even at a low input voltage, where the switches 63 cause as many PN junction light-emitting elements 15 as possible to emit light and short the remaining PN junction light-emitting elements 15. The switches 63 shown in FIGS. 2 and 3 can be easily implemented by using an OP amp comparator OP1 for sensing whether the magnitude of an AC voltage of a switching transistor T reaches a set value.

A typical example of the PN junction light-emitting element 15 is a light-emitting diode (LED), and another example thereof may include a laser diode (LD). The LED may include, for example, a light-emitting chip, a fixed frame for holding the light-emitting chip, and an input lead line and an output lead line electrically connected to wiring of the power transmitting substrate 21. As shown in FIG. 1, the PN junction light-emitting elements 15 are mounted in an array on the power transmitting substrate 21, thus configuring a PN junction light-emitting element module 10.

The PN junction light-emitting element module 10 is disposed on the bottom cover 30. The bottom cover 30 may be made of plastic, and, as shown in FIG. 1. the bottom cover 30 may have a receiving recess 31 into which the power transmitting substrate 21 is to be inserted. A screw fastening portion, for example, screw fastening holes 33 are formed at the corners of the bottom cover 30. The metal layer of the power transmitting substrate 21 is in contact with the bottom cover 30, and heat generated during the light emission of the PN junction light-emitting elements 15 is dissipated via the metal layer of the power transmitting substrate 21 and the bottom cover 30. As set forth herein, the lighting apparatus 5 has significantly reduced volume and weight because it has no heat sink having a heat dissipation fin or heat radiation blade. To improve the heat dissipation characteristics, the bottom cover 30 may be made of heat dissipation plastic having excellent heat dissipation characteristics. Moreover, an excessive temperature rise can be suppressed by decreasing the number of PN junction light-emitting elements 15 mounted on the power transmitting substrate 21.

Moreover, since the receiving recess 33 is formed in the bottom cover 30 as described above, the heat dissipation efficiency can be improved by a reduction in the thickness of the bottom cover 30.

Figure 4:
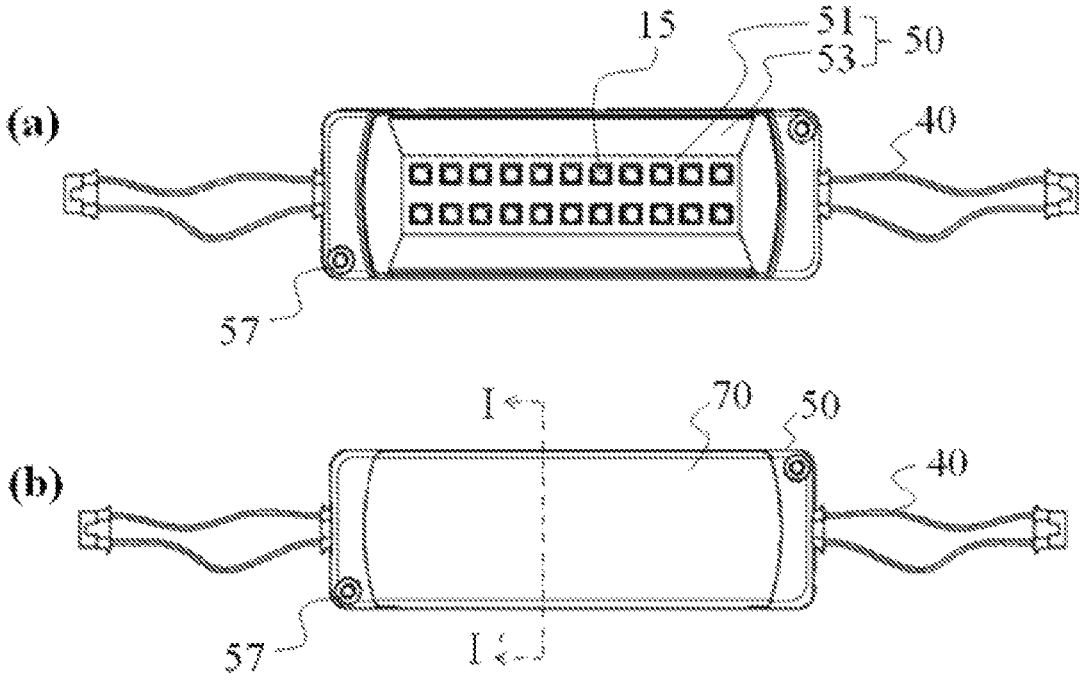
FIG. 4 is a view showing the front surface of the lighting apparatus using the PN junction light-emitting element of FIG. 1.
Figure 5:
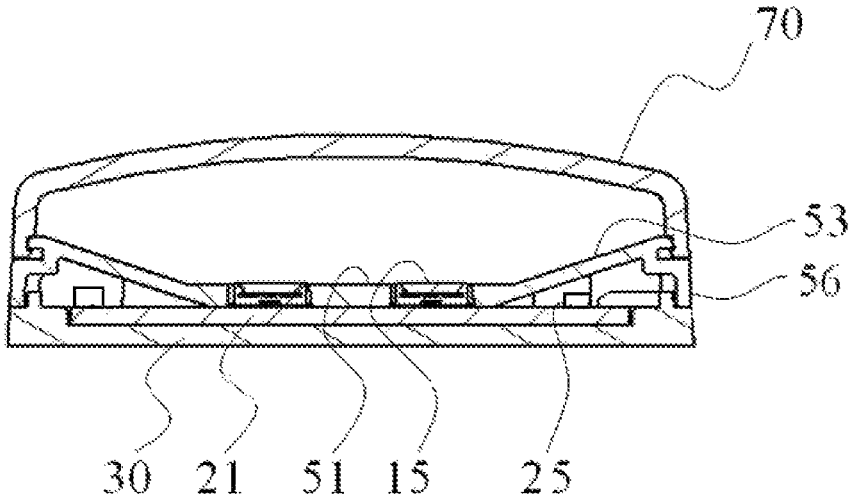
FIG. 5 is a sectional view taken along line I-I' of FIG. 4.

FIGS. 4*a* and 4*b* are views showing the front surface of the lighting apparatus using the PN junction light-emitting element of FIG. 1. FIG. 5 is a sectional view taken along line I-I' of FIG. 4.

The top cover 50 is positioned on the power transmitting substrate 21 and coupled to the bottom cover 30. The top cover 50 may include a base portion 51, a sloping portion 53, and a side portion 56. Openings 55 corresponding to the PN junction light-emitting elements 15 are formed in the base portion 51. The PN junction light-emitting elements 15 may be exposed through the openings 55 as shown in FIG. 4*a* and inserted into the openings 55 as shown in FIG. 5. The sloping portion 53 extends from an edge of the base portion 51, and, as shown in FIG. 5, extends upward so as to form an angle of inclination with respect to the base portion 51. The sloping portion 53 corresponds to a periphery of the power transmitting substrate 21, and a space is defined between the power transmitting substrate 21 and the sloping portion 53 where the above-described circuit elements 25 are to be seated. The side portion 56 extends downward from the upper end of the sloping portion 53 and is coupled to the bottom cover 30. For example, as shown in FIG. 1, a fastening protrusion 54 is provided on the side portion 56, and the bottom cover 30 may have a fastening hole into which the fastening protrusion 54 is inserted in a hook coupling manner. The top cover 50 may have a screw fastening hole 57 corresponding to the bottom cover 30.

The transparent window 70 is positioned over the top cover 50 as shown in FIGS. 4*b* and 5, and a guide slot in which the transparent window 70 is placed is formed in the upper end of the side portion 56 of the top cover 50. The transparent window 70 shields and protects the PN junction light-emitting elements 15 from the outside. The transparent window 70 may be made of transparent plastic and may transmit light coming from the PN junction light-emitting elements 15 and adjust the orientation angle of the light.

As described above, the lighting apparatus 5 performs heat dissipation from the power transmitting substrate 21 to the bottom cover 30 without using a separate heat sink and realizes a compact coupling structure of the bottom cover 30, the power transmitting substrate 21, the top cover 50 and the transparent window 70 without including a separate drive circuit. Accordingly, it is possible to provide the slim and lightweight lighting apparatus 5.

Figure 6:
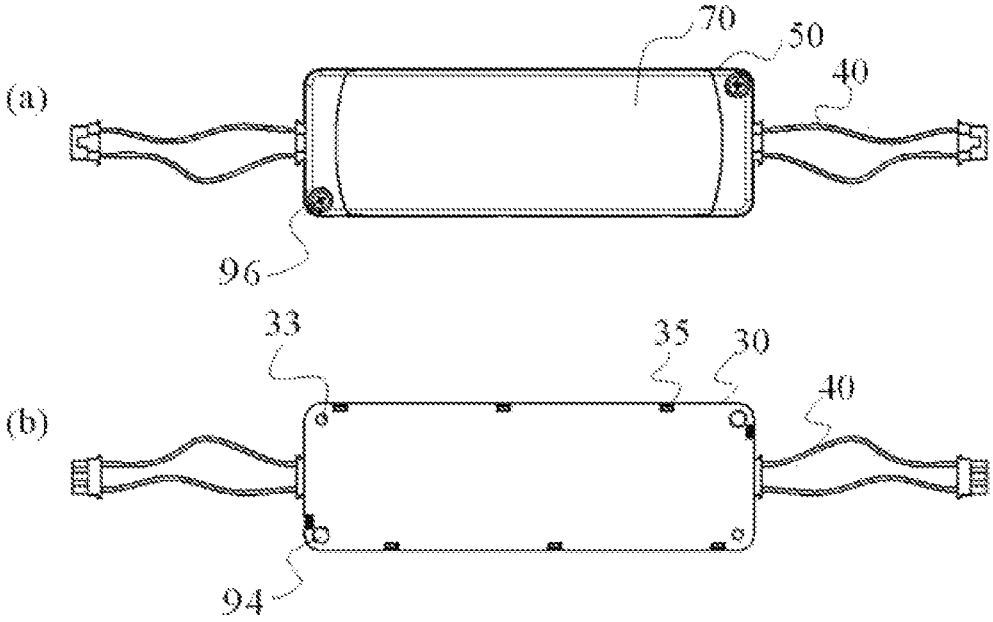
FIG. 6 is a view showing the front and rear surfaces of the lighting apparatus using the PN junction light-emitting element.

FIG. 6 is a view showing the front and rear surfaces of the lighting apparatus using the PN junction light-emitting element.

The lighting apparatus 5 may be installed in plural number in a lighting fixture by means of screws 96 as shown in FIG. 6*a*, or may be individually installed on a wall, a ceiling, etc. Alternatively, as shown in FIG. 6*b*, a magnet 94 may be provided on the rear surface of the bottom cover 30, so that the lighting apparatus 5 can be attached to another object by the magnet 94. Attaching the lighting apparatus 5 by the magnet 94 offers the advantage that the position of the lighting apparatus 5 can be easily changed as needed.

Figure 7:
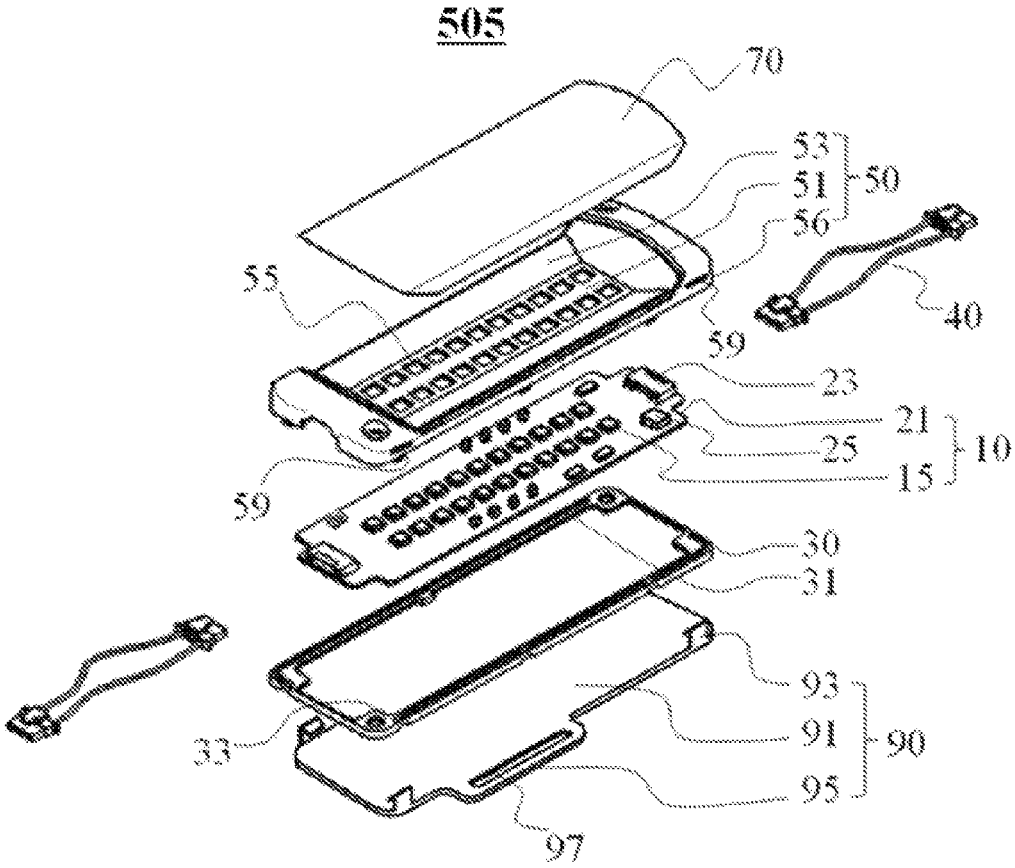
FIG. 7 is a view showing another example of the lighting apparatus using the PN junction light-emitting element according to the present disclosure.
Figure 8:
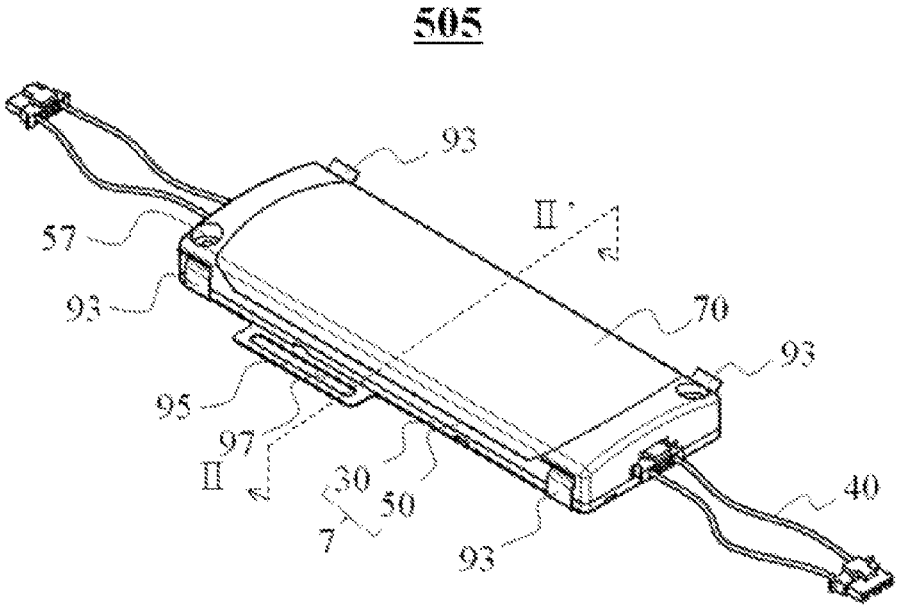
FIG. 8 is a view showing the outer appearance of the lighting apparatus using the PN junction light-emitting element of FIG. 7.

FIG. 7 is a view showing another example of the lighting apparatus using the PN junction light-emitting element according to the present disclosure. FIG. 8 is a view showing the outer appearance of the lighting apparatus using the PN junction light-emitting element of FIG. 7.

The lighting apparatus 505 using a PN junction light-emitting element includes a power transmitting substrate 21, PN junction light-emitting elements 15, a bottom cover 30, a top cover 50, a transparent window 70, and a bracket 90.

The lighting apparatus 505 is substantially identical to the lighting apparatus 5 using a PN junction light-emitting element explained with reference to FIGS. 1 to 6 except that a fastening slot 59 is formed in the top cover 50 and a bracket 90 is further included. Accordingly, like components are given like reference numerals, and duplicate description thereof will be omitted.

As shown in FIGS. 7 and 8, the bottom cover 30 and the top cover 50 are coupled to form a casing 7. The power transmitting substrate 21 on which the PN junction light-emitting elements 15 are mounted is housed in the casing 7.

The bracket 90 is coupled to the casing 7 and secures the casing 7 to another object, such as a lighting fixture. The bracket 90 will be described later in detail.

Figure 9:
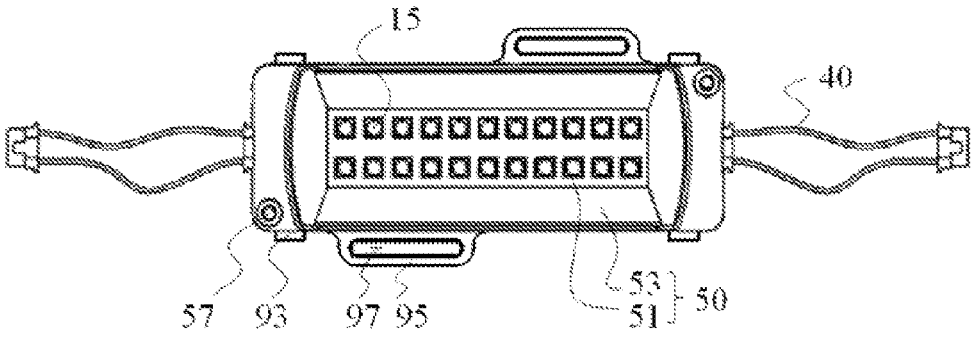
FIG. 9 is a view showing a bracket, PN junction light-emitting elements and a top cover of FIG. 7.
Figure 10:
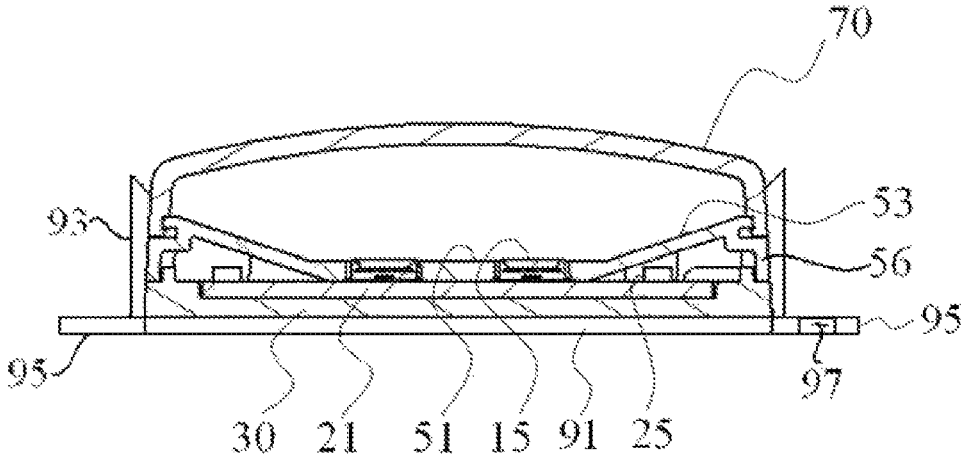
FIG. 10 is a sectional view taken along line II-II' of FIG. 8.

FIG. 9 is a view showing the bracket, PN junction light-emitting elements, and top cover of FIG. 7. FIG. 10 is a sectional view taken along line II-II' of FIG. 8.

The top cover 50 is positioned over the power transmitting substrate 21 and coupled to the bottom cover 30. The top cover 50 may include, as shown in FIG. 10, a base portion 51, a sloping portion 53, and a side portion 56.

Fastening slots 59 for fastening the bracket 90 may be formed in the four corner sides of the side portion 56 as shown in FIG. 7. The bracket 90 may be made of metal or plastic. The bracket 90 includes, for example, a main body 91, a first coupling portion 93, and a second coupling portion 95.

As shown in FIGS. 7, 8 and 10, the main body 91 may be positioned on the rear surface of the bottom cover 30. The first coupling portion 93 is, for example, a hook 93 that extends from the main body 91 and is coupled to a fastening slot 59 formed in the side portion 56 of the top cover 50. Four first coupling portions 93 extend from near the four corners of the long-side edges of the main body 91. The height from the rear surface of the bottom cover 30 to the fastening slot 59 is greater than the height of the hook 93, so that the hook 93 can be press-fitted into the fastening slot 59.

The second coupling portions 95 may extend from the long-side edges of the main body 91 so as to be exposed to the sides of the bottom cover 30. In order to install a plurality of casings 7 in a compact manner, as shown in FIG. 9, it is preferable that the second coupling portions 95 should be formed at staggered positions on the opposite long sides of the main body 91. A bracket fixing hole 97 is elongated in the second coupling portion 95 as shown in FIGS. 7 and 9, thus making it possible to relatively freely select a fastening position. With the second coupling portion 95 being formed in a staggered manner on the opposite sides of the main body 91 and the bracket fixing hole 97 being longitudinally formed, the installation of the lighting apparatus is made easy.

The shape of the bracket 90 may be different from the aforementioned one. For example, the bracket 90 may be formed in the shape of a chassis in which the main body 91 corresponds not to the entire rear surface of the bottom cover 30 but only to the periphery of the rear surface of the bottom cover 30, and the shapes of the first coupling portion 93 and the second coupling portion 95 may be changed in various ways.

The above-described lighting apparatus 505 may be implemented as a single lighting apparatus or implemented in an array in plural number.

Figure 11:
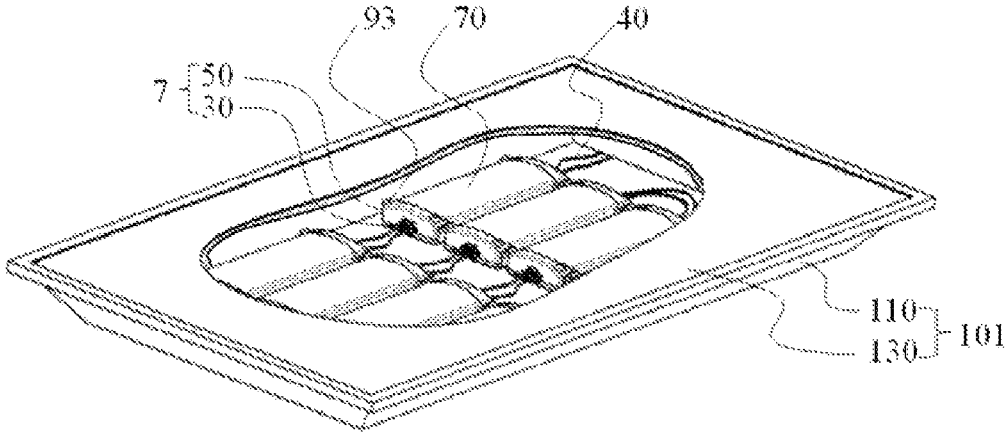
FIG. 11 is a view showing a lamp having a plurality of lighting apparatuses using a PN junction light-emitting element being installed in a lighting fixture.
Figure 12:
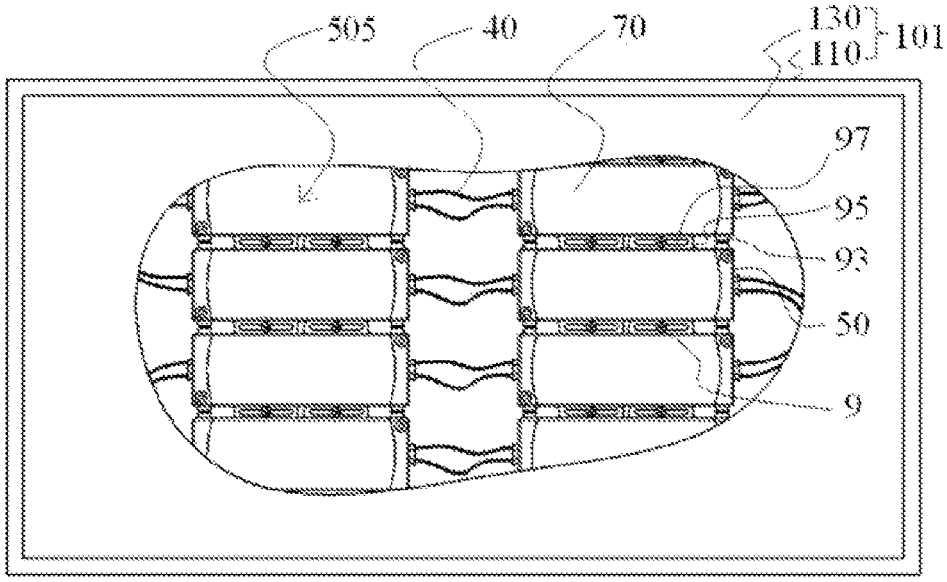
FIG. 12 is a view showing the front surface of the lamp of FIG. 11.

FIG. 11 is a view showing a lamp having a plurality of lighting apparatuses using a PN junction light-emitting element being installed in a lighting fixture. FIG. 12 is a view showing the front surface of the lamp of FIG. 11.

The lighting fixture 101 is a kind of lighting fixture used for various purposes, such as a streetlight or an interior light. The lighting fixture 101 may include a lighting fixture body 110 and a light transmissive front cover 130. As shown in FIGS. 11 and 12, the plurality of lighting apparatuses 505 are installed in the lighting fixture body 110. As discussed above, the connectors of the plurality of lighting apparatuses 505 are electrically connected to each other via a connection cable 40, and an electrical connection method of the plurality of lighting apparatuses 505 can be easily changed depending on how the connection cable 40 is to be connected.

The second coupling portions 95 of the neighboring brackets 90 are installed in a staggered manner as shown in FIG. 12, thereby enabling it to install the neighboring lighting apparatuses 505 in a compact manner. Since the bracket fixing hole 97 formed in the second coupling portion 95 is elongated, a screw fastening position can be selected as desired in the bracket fixing hole 97. Moreover, the lighting fixture 101 can be configured to be slim and lightweight because the lighting apparatus 505 is slim and lightweight as described above, and various kinds of lamps can be easily configured by varying the number and array of the lighting apparatuses 505.

Figure 13:
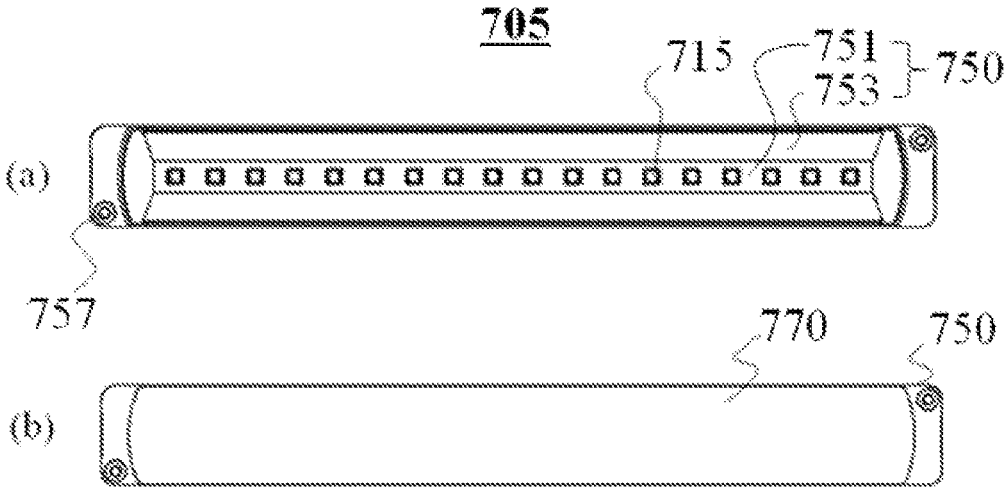
FIG. 13 is a view showing still another example of the lighting apparatus using the PN junction light-emitting element according to the present disclosure.
Figure 14:
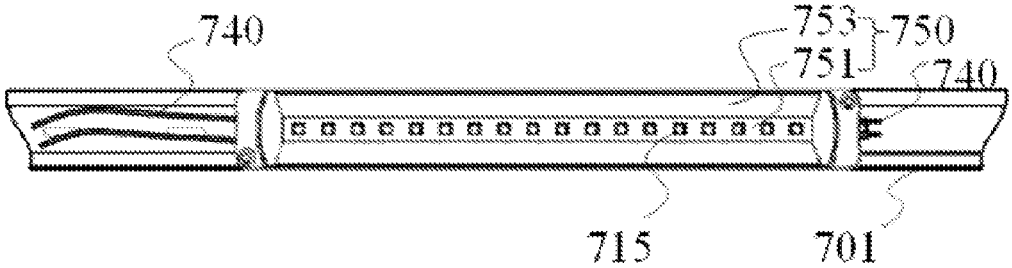
FIG. 14 a view showing a lamp having a lighting apparatus using a PN junction light-emitting element of FIG. 13 being installed on a rail.
Figure 15:
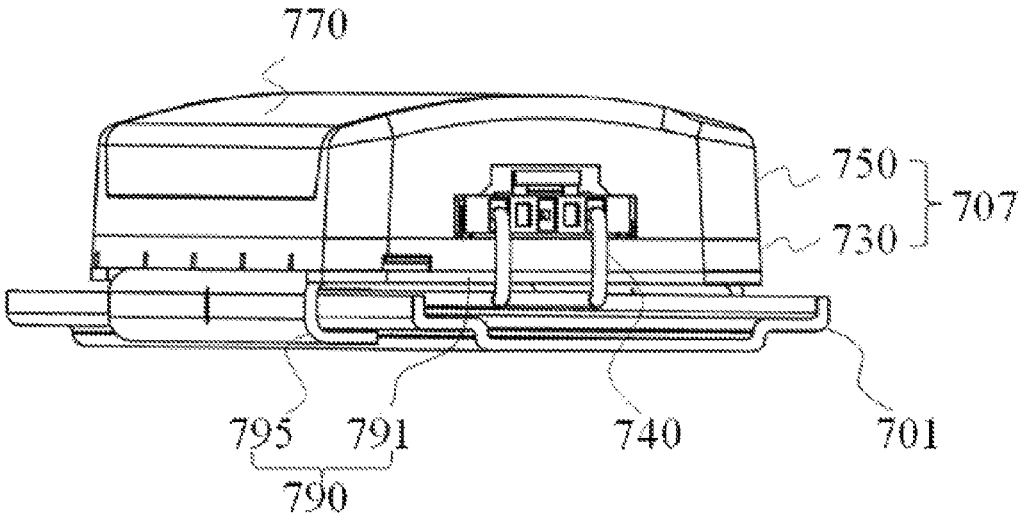
FIG. 15 is a view showing the lamp of FIG. 14 from a different angle.

FIGS. 13*a* and 13*b* are views showing still another example of the lighting apparatus using the PN junction light-emitting element according to the present disclosure. FIG. 14 a view showing a lamp having a lighting apparatus using a PN junction light-emitting element of FIG. 13 being installed on a rail. FIG. 15 is a view showing the lamp of FIG. 14 from a different angle.

A lighting apparatus 705 is substantially identical to the lighting apparatus 505 explained with reference to FIGS. 7 to 12 except that it is a fluorescent lamp type elongated in one side and installed on a guide rail 701, and a bracket 790 has a different shape. Accordingly, like components are given like reference numerals, and duplicate description thereof will be omitted.

PN junction light-emitting elements 715 are longitudinally arrayed in a row on a power transmitting substrate (not shown) and configured in a fluorescent lamp type. The power transmitting substrate is housed in a casing 707 which is composed of a bottom cover 730 and a top cover 750. Openings corresponding to the PN junction light-emitting elements 715 are formed in a top cover 750. A transparent window 770 is coupled to the top cover 750.

As discussed earlier, it is preferable that heat should be dissipated directly via the bottom cover 730 from the power transmitting substrate without using a separate heat sink and that the power transmitting substrate should not have an electrolytic capacitor.

The bracket 790 is coupled to the bottom cover 730 and secures the casing 707 to the guide rail 701.

The guide rail 701 may be installed on a ceiling or wall or outdoors, and one or more lighting apparatuses 705 may be installed on the guide rail 701.

A first coupling portion (not shown) of the bracket 790 may be protruded from a main body 791 and fastened to a slot formed in the rear surface of the bottom cover 730.

A second coupling portion 795 is, for example, a slider 795 coupled to the guide rail 701 as shown in FIG. 15. The slider 795 is movable along the guide rail 701. Alternatively, a stopper (not shown) may be installed on the slider 795 or the casing 707 so as to be secured at a desired position of the guide rail 701. Otherwise, the slider 795 may be coupled and fixed to the guide rail 701. Since the guide rail 701 is installed in a desired location and one or more lighting apparatuses 705 are easily installed on the guide rail 701 by the bracket 790, the lamp can be of various configurations and be easily installed.

Figure 16:
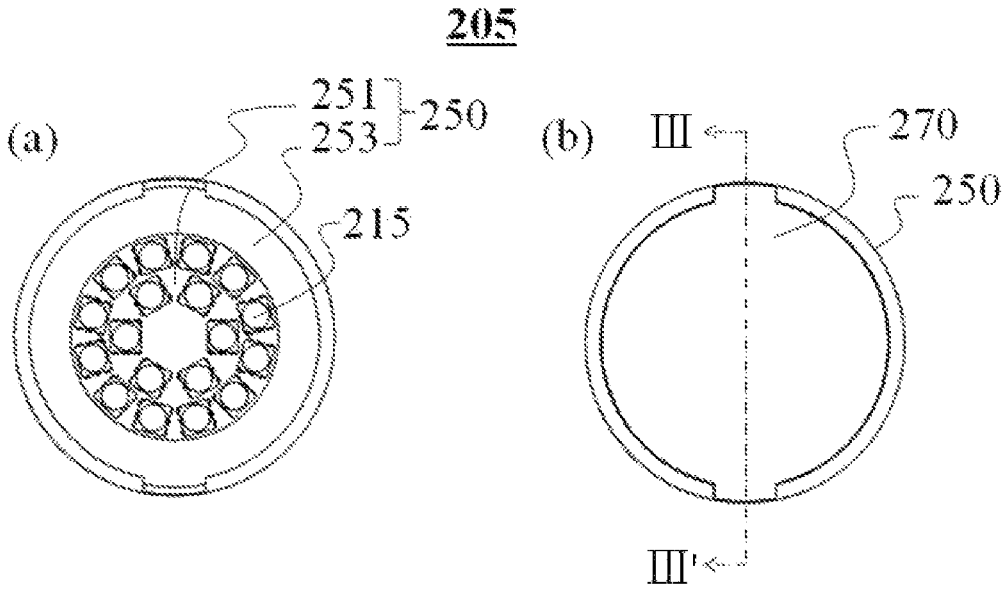
FIG. 16 is a view showing a further example of the lighting apparatus using the PN junction light-emitting element according to the present disclosure.
Figure 17:
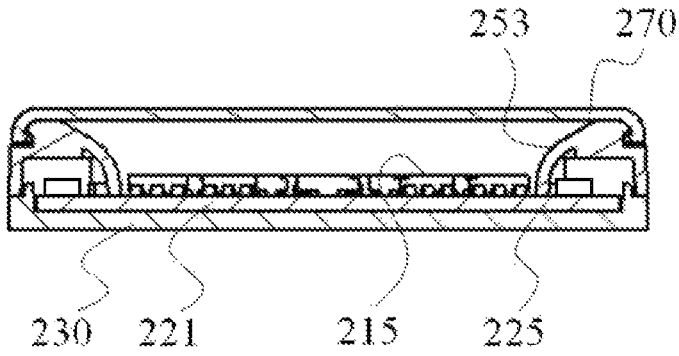
FIG. 17 is a sectional view taken along line III-III' of FIG. 16.

FIG. 16 is a view showing a further example of the lighting apparatus using the PN junction light-emitting element according to the present disclosure. FIG. 17 is a sectional view taken along line III-III' of FIG. 16.

The lighting apparatus 205 is substantially identical to the lighting apparatus 5 explained with reference to FIGS. 1 to 6 except that it has a circular shape. Accordingly, like components are given like reference numerals, and duplicate description thereof will be omitted.

The power transmitting substrate 221 has a disc shape, and, as shown in FIG. 17, is housed between the bottom cover 230 and the top cover 250. The PN junction light-emitting elements 215 are arranged in a circular pattern as shown in FIG. 16(*a*). Circuit elements 226 are disposed on the periphery of the power transmitting substrate 221 as shown in FIG. 17, a sloping portion 253 of the top cover 250 corresponds to the periphery of the power transmitting substrate 221, and the circuit elements 226 are positioned under the sloping portion 253.

The PN junction light-emitting elements 215 may be three-chip PN junction light-emitting elements, each having three chips packaged therein, and can change the light amount by changing the chip size.

Hereinafter, various exemplary embodiments of the present disclosure will be described.

(1) A lighting apparatus using a PN junction light-emitting element, wherein a top cover includes: a base portion having openings into which the PN junction light-emitting elements are to be inserted; and a sloping portion extending from the base portion and spaced apart from a power transmitting substrate.

(2) A lighting apparatus using a PN junction light-emitting element, wherein a power transmitting substrate includes: a connector into which external power is input; and circuit elements positioned under the sloping portion and associated with power control.

(3) A lighting apparatus using a PN junction light-emitting element, wherein a power transmitting substrate does not include an electrolytic capacitor as a circuit element.

(4) A lighting apparatus using a PN junction light-emitting element, wherein a circuit element includes: a bridge rectifying circuit for rectifying AC to drive the PN junction light-emitting elements; and at least one switch, which is connected to at least one of the plurality of PN junction light-emitting elements connected in series, allows electric current to flow even when an input voltage is lower than the voltage causing the entire PN junction light-emitting elements connected in series to emit light, thereby causing as many PN junction light-emitting elements as possible to emit light, and bypasses the remaining PN junction light-emitting elements.

As the methods of driving the PN junction light-emitting elements by AC, various driving methods utilizing pulsating current, as well as the above method using the circuit elements, can be employed. Additionally, the lighting apparatus using the PN junction light-emitting element according to the present disclosure employs both the method of driving the PN junction light-emitting elements by AC without having circuit elements provided on the power transmitting substrate and the method of disposing the PN junction light-emitting elements in both directions and driving them by AC power without using a bridge rectifying circuit. Besides, various methods of driving the PN junction light-emitting elements may be applied to the configuration of the power transmitting substrate. For instance, a drive circuit using switching mode power supply (SMPS) may be provided on the power transmitting substrate.

(5) A lighting apparatus using a PN junction light-emitting element, wherein the bottom cover is made of plastic and has a receiving recess into which the power transmitting substrate is to be inserted.

While the bottom cover may be made of plastic to reduce the weight, the bottom cover may be made of metal to improve heat dissipation efficiency.

(6) A lighting apparatus using a PN junction light-emitting element, wherein a power transmitting substrate includes: a metal layer brought into contact with the bottom cover; a wiring layer formed over the metal layer and electrically connected to the PN junction light-emitting elements; a connector provided on the wiring layer and receiving external power; and circuit elements positioned under a sloping portion and associated with power control.

The metal layer is an example of a configuration for improving heat dissipation efficiency, and various configurations may be applied to improve the heat dissipation characteristics of the power transmitting substrate. A heat dissipation tape, a heat dissipation sheet, etc. may be added between the power transmitting substrate and the bottom cover.

(7) A lighting apparatus using a PN junction light-emitting element, wherein the apparatus further includes a magnet provided on the rear surface of a bottom cover to secure the lighting apparatus using the PN junction light-emitting element to another object.

(8) A lighting apparatus using a PN junction light-emitting element, wherein the apparatus further includes a screw fastening portion provided on a bottom cover and a top cover to secure the lighting apparatus using the PN junction light-emitting elements to another object.

(9) A lighting apparatus using a PN junction light-emitting element, wherein the apparatus further includes a bracket having: a main body positioned on a bottom cover; a first coupling portion extending from the main body and coupled to a top cover; and a second coupling portion extending from the main body and securing the bottom cover and the top cover to another object.

The bracket may have various shapes. A bracket whose contact area with the rear surface of the casing is wide will be more advantageous for heat dissipation. When the bracket and the bottom cover are made of metal, the heat dissipation efficiency can be further improved.

(10) A lighting apparatus using a PN junction light-emitting element, wherein a casing includes: a bottom cover positioned under a power transmitting substrate and coupled to another object by a bracket; and a top cover that supports a transparent window, is coupled to the bottom cover, and has openings exposing the PN junction light-emitting elements toward the transparent window.

(11) A lighting apparatus using a PN junction light-emitting element, wherein a bracket includes: a main body positioned on a bottom cover; a first coupling portion extending from the main body and coupled to a casing; and a second coupling portion extending from the main body and securing the casing to another object.

(12) A lighting apparatus using a PN junction light-emitting element, wherein a first coupling portion includes a hook fastened to a slot formed in a top cover.

(13) A lighting apparatus using a PN junction light-emitting element, wherein a second coupling portion extends from the main body and has a bracket fixing hole to be fastened to another object.

(14) A lighting apparatus using a PN junction light-emitting element, wherein a bracket fixing hole is elongated so that a fastening position can be selected therein.

(15) A lighting apparatus using a PN junction light-emitting element, wherein a plurality of casings, each housing a power transmitting substrate, are installed in a lighting fixture by means of brackets, and second coupling portions of the neighboring brackets are placed in a staggered manner.

Lamps of various uses and sizes can be configured depending on the number and installation methods of lighting apparatuses using a PN junction light-emitting element in a lighting fixture. Various methods, such as screw fastening, hook fastening, etc., can be applied to the coupling of the brackets, the casings and the lighting fixture.

(16) A lighting apparatus using a PN junction light-emitting element, wherein second coupling portions extend from staggered positions of the opposite sides of a main body, respectively, are exposed to the opposite sides of the casing, respectively, and have a bracket fixing hole to be coupled to a lighting fixture.

(17) A lighting apparatus using a PN junction light-emitting element, wherein a power transmitting substrate includes a connector to which power is input, and the power transmitting substrates housed in a plurality of casings are electrically connected by a connection cable that interconnects the connectors.

(18) A lighting apparatus using a PN junction light-emitting element, wherein a second coupling portion includes a slider coupled to a guide rail.

The lighting apparatus using the PN junction light-emitting element according to the present disclosure allows a reduction in volume and weight because no heat sink is required.

In addition, a reduction in volume and weight is achieved because no separate drive substrate is required, other than the power transmitting substrate having the PN junction light-emitting elements mounted thereon.

Moreover, the circuit elements provided on the power transmitting substrate do not include an electrolytic capacitor having low resistance to heat, thereby preventing deterioration of reliability such as lifespan.

Further, it is possible to provide the slim and lightweight lighting apparatus using the PN junction light-emitting element because the bottom cover, the power transmitting substrate, the top cover and the transparent window have a compact coupling structure.

Furthermore, the lighting apparatus using the PN junction light-emitting element according to the present disclosure makes it possible to configure a lamp in various ways and makes installation easy because the lighting apparatus using the PN junction light-emitting element can be easily installed in the lighting fixture or on the rail by means of the bracket.

Still furthermore, it is possible to provide the slim and lightweight lighting apparatus using the PN junction light-emitting element because the bottom cover, the power transmitting substrate, the top cover, the transparent window and the bracket have a compact coupling structure.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

What is claimed is:

1. A lighting apparatus using a PN junction light-emitting element, the apparatus comprising:

a power transmitting substrate;

PN junction light-emitting elements mounted on the power transmitting substrate;

circuit elements mounted on the power transmitting substrate and controlling power provided to the PN junction light-emitting elements; and a top cover covering the circuit elements and forward reflecting light emitted by the PN junction light-emitting elements, wherein the top cover comprises:

a base portion having a plurality of openings, each of which corresponds to the PN junction light-emitting elements; and a sloping portion extending from the base portion, wherein the sloping portion has a slope with respect to the base portion and is positioned over the circuit elements, and wherein the power transmitting substrate comprises a connector positioned under the sloping portion, and wherein external power is applied to the connector.

2. The lighting apparatus of claim 1, wherein the circuit elements do not comprise an electrolytic capacitor and control AC power to drive the PN junction light-emitting elements.

3. The lighting apparatus of claim 1, wherein the circuit element comprises:

a bridge rectifying circuit for rectifying AC power to drive the PN junction light-emitting elements; and at least one switch connected to at least one of the plurality of PN junction light-emitting elements connected in series, wherein even when an input voltage is lower than the voltage causing the entire PN junction light-emitting elements connected in series to emit light, the at least one switch allows electric current to flow to cause as many PN junction light-emitting elements as possible to emit light and bypasses the remaining PN junction light-emitting elements.

4. The lighting apparatus of claim 1, wherein the apparatus further comprises a bottom cover positioned under the power transmitting substrate.

5. The lighting apparatus of claim 4, wherein the power transmitting substrate comprises:

a metal layer brought into contact with the bottom cover; and a wiring layer formed over the metal layer and electrically connected to the PN junction light-emitting elements;

wherein the connector provided on the wiring layer and receiving external power.

6. The lighting apparatus of claim 4, wherein the apparatus further comprises a magnet provided on the bottom cover to secure the lighting apparatus using the PN junction light-emitting element to another object.

7. The lighting apparatus of claim 4, wherein the apparatus further comprises a screw fastening portion provided on the bottom cover and the top cover to secure the lighting apparatus using the PN junction light-emitting elements to another object.

8. The lighting apparatus of claim 4, wherein the bottom cover has a recess on which the power transmitting substrate is positioned.

9. The lighting apparatus of claim 4, wherein the apparatus further comprises a bracket coupled to the bottom cover.

10. The lighting apparatus of claim 9, wherein the bracket comprises:

a main body positioned on the bottom cover;

a first coupling portion extending from the main body and coupled to the top cover; and a second coupling portion extending from the main body and securing the bottom cover and the top cover to another object.

11. The lighting apparatus of claim 10, wherein the apparatus further comprises:

a lighting fixture in which a plurality of top covers and bottom covers are installed by means of brackets;

connectors each mounted on power transmitting substrates, each of which is housed between the top covers and the bottom covers; and at least one connection cable electrically connecting the power transmitting substrates to each other by interconnecting the connectors.

12. The lighting apparatus of claim 10, wherein the top cover has a slot and the first coupling portion comprises a hook fastened to the slot.

13. The lighting apparatus of claim 10, wherein the second coupling portion extends from the main body and has a bracket fixing hole to be fastened to the another object.

14. The lighting apparatus of claim 10, wherein the apparatus further comprises a guide rail on which the bottom cover is installed by the bracket.

15. The lighting apparatus of claim 11, wherein the second coupling portions extend from staggered positions of the opposite sides of the main body, respectively, are exposed to the opposite sides of the bottom cover, respectively, and second coupling portions of the neighboring brackets are placed in a staggered manner.

16. The lighting apparatus of claim 13, wherein the bracket fixing hole is elongated so that a fastening position can be selected therein.

17. The lighting apparatus of claim 14, wherein the second coupling portion comprises a slider coupled to the guide rail.

18. The lighting apparatus of claim 1, wherein the apparatus further comprises a transparent window positioned on the top cover, and wherein the top cover has at least one opening exposing the PN junction light-emitting elements and the transparent window closes the at least one opening.

* * * * *